US012410935B2

(12) United States Patent
Galchenko et al.

(10) Patent No.: US 12,410,935 B2
(45) Date of Patent: Sep. 9, 2025

(54) COMPUTERIZED DEVICE AND COMPUTER-IMPLEMENTED METHOD FOR CONTROLLING A HVAC SYSTEM

(71) Applicant: Siemens Schweiz AG, Zürich (CH)

(72) Inventors: Olga Galchenko, St. Petersburg (RU); Mikhail Gritckevich, St. Petersburg (RU); Evgeny Ivanov, St. Petersburg (RU)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 459 days.

(21) Appl. No.: 17/914,497

(22) PCT Filed: Mar. 27, 2020

(86) PCT No.: PCT/RU2020/000162
§ 371 (c)(1),
(2) Date: Sep. 26, 2022

(87) PCT Pub. No.: WO2021/194369
PCT Pub. Date: Sep. 30, 2021

(65) Prior Publication Data

US 2023/0131098 A1 Apr. 27, 2023

(51) Int. Cl.
*F24F 11/63* (2018.01)
*F24F 110/20* (2018.01)
*F24F 110/70* (2018.01)

(52) U.S. Cl.
CPC ..... *F24F 11/63* (2018.01); *F24F 2110/20* (2018.01); *F24F 2110/70* (2018.01)

(58) Field of Classification Search
CPC .... F24F 11/63; F24F 2110/20; F24F 2110/70; F24F 11/30; F24F 11/0001; F24F 11/46;
(Continued)

(56) References Cited

U.S. PATENT DOCUMENTS 6,173,902 B1 * 1/2001 Bauer ..... B60H 1/00864 236/91 C
12,066,798 B2 * 8/2024 Wan ..... F24F 11/46
(Continued)

FOREIGN PATENT DOCUMENTS

CN 105473354 A 4/2016 ..... B60H 1/00
CN 105805887 A 7/2016
(Continued)

OTHER PUBLICATIONS

Search Report for International Application No. PCT/RU2020/000162, 12 pages.
(Continued)

*Primary Examiner* — Alicia M. Choi
(74) *Attorney, Agent, or Firm* — Slayden Grubert Beard PLLC

(57) ABSTRACT

Various embodiments of the teachings herein include a device for controlling a HVAC system of a room. The device may include: a memory storing a metamodel for a distribution of physical quantities of air in the room, the metamodel based on reduced order modeling of a plurality of executed simulations of the physical quantities for a first configuration of the room; and a processor programmed to determine a value of a first subset of the physical quantities at a certain
(Continued)

location in the room using the metamodel and a set of measured values of each physical quantity being measured by a number of physical sensors.

10 Claims, 2 Drawing Sheets

(58) Field of Classification Search
CPC .. F25B 49/02; F25B 2500/19; F25B 2600/11; B60H 1/0073
See application file for complete search history.

(56) References Cited

U.S. PATENT DOCUMENTS

| | | | | |
|---|---|---|---|---|
| 2014/0039844 | A1* | 2/2014 | Strelec | G06F 30/13 703/1 |
| 2016/0209065 | A1 | 7/2016 | Hagström et al. | 700/276 |
| 2016/0246269 | A1 | 8/2016 | Ahmed et al. | 700/276 |
| 2017/0074535 | A1* | 3/2017 | Booij | G05B 19/048 |
| 2018/0082204 | A1* | 3/2018 | Iwamasa | G05B 17/02 |
| 2018/0252427 | A1* | 9/2018 | Hieke | F24F 11/62 |
| 2020/0004214 | A1 | 1/2020 | Ahmed et al. | |
| 2020/0082036 | A1* | 3/2020 | Saito | G06F 30/15 |
| 2021/0173365 | A1 | 6/2021 | Ahmed et al. | |
| 2022/0221149 | A1* | 7/2022 | Carroll | F23N 1/022 |

FOREIGN PATENT DOCUMENTS

| | | | |
|---|---|---|---|
| CN | 107223195 A | 9/2017 | |
| WO | 2019 197324 | 10/2019 | G05B 17/02 |

OTHER PUBLICATIONS

Ghosh, Rajat et al:; "Proper Orthogonal Decomposition-Based Modeling Framework for Imrpoved Spatial Resolution of Measured Temperature Data"; IEEE Transactions on Components, Packaging and Manufacturing Technology; IEEE; vol. 4; No. 5; pp. 848-858; XP011547474; ISSN: 2156-3950; DOI: 10.1109/TCPMT.2013.2291791.

Harish, V.S.K.V. et al:; "Reduced order modeling and parameter identification of a building energy system model through an optimization routine"; Applied Energy; Elsevier Science Publishers; vol. 162; pp. 1010-1023; XP029327424; ISSN: 0306-2619; DOI: 10.1016/J.APENERGY.2015.10.137.

Phan, Long et al:; "Reduced order modeling of data center model with multi-Parameters"; Energy and Buildings; Lausanne; vol. 136; pp. 86-99; XP029860856; ISSN: 0378-7788; DOI: 10.1016/J.ENBUILD.2016.11.050.

Chinese Office Action, Application No. 202080099121.X, 9 pages, Jan. 27, 2024.

* cited by examiner

COMPUTERIZED DEVICE AND COMPUTER-IMPLEMENTED METHOD FOR CONTROLLING A HVAC SYSTEM

CROSS-REFERENCE TO RELATED APPLICATIONS

This application is a U.S. National Stage Application of International Application No. PCT/RU2020/000162 filed Mar. 27, 2020, which designates the United States of America, the contents of which are hereby incorporated by reference in their entirety.

TECHNICAL FIELD

The present disclosure relates HVAC systems (HVAC: Heating, Ventilation, and Air Conditioning). Various embodiments of the teachings herein may include HVAC systems, computerized devices, and/or methods for controlling a HVAC system.

BACKGROUND

Nowadays, the HVAC industry is a fast-growing technical field which follows the common trends of digitalization by employing the IoT concept (IoT: Internet of Things) of connecting various smart devices and sensors within a single ecosystem. In particular, the quality control of such a HVAC system, which typically involves analysis of temperature, removal of moisture, smoke, heat, dust, carbon dioxide and other gases, is performed in order to fit the existing standards and provide appropriate space for persons or mechanisms. In order to provide technical solutions, different manufactures are employing smart control devices to ensure the highest level of comfort. Particularly, the so-called "perfect place" concept incorporates the usage of IoT devices, smart sensors and cloud technology for the solution of such a challenging task.

However, the conventional solutions have a certain technology issue, which significantly reduces the efficiency and customization capabilities. Particularly, the control of such conventional systems is performed based on the information from physical sensors placed at respective predefined locations in a room. The respective location is often selected to account for certain room peculiarities, which increases the reliability of the sensor indication. Nevertheless, taking into account that sensors could hardly be placed at room locations where people normally inhabit, the data from the respective physical sensor is not guaranteed to match the specified conditions making the room less comfortable.

For example, in a certain room, where a physical sensor is located at a defined location, the physical sensor may sense the temperature of 24° C., wherein within a significant region of the room, the temperature may be much lower and, therefore, the conventional system cannot guarantee the desired temperature for people in the room located far away from the physical sensor. Increasing the number of physical sensors in the room can improve the predictive capability of the described HVAC system. However, this increases the total cost and the difficulty of the setup procedure of such a HVAC system.

It may be noted that the control of a HVAC system may be performed in several ways. The most straightforward way is to apply the required settings manually to the HVAC system, namely with the use of a remote controller or directly. In such a case, no physical sensors are implemented outside the device. A more sophisticated approach implies the usage of smart sensors, such as the Siemens Smart Thermostat RDS120. For this case, the desired temperature is set for the device manually or with the use of a remote controller, the current temperature measured by at least one physical sensor is compared with the input one and the HVAC system working regime is set according to a certain algorithm aiming at matching the current sensor temperature to the desired value. It may be noted that the Siemens Smart Thermostat incorporates several indoor air quality sensors acting similarly temperature sensor, such as relative humidity sensor or VOC and $CO_2$ sensors.

However, despite the ability to control the performance of the HVAC system based on the sensor the above-mentioned approach employs several restrictions for the sensor location. According to the user's manual of the Siemens Smart Thermostat RDS120, only several locations satisfy the requirements for sensor placement. Here, it is worth mentioning that the appropriate locations are quite far from the potential human locations, so this concept may not solve the above-mentioned issue.

SUMMARY

The teachings of the present disclosure may be used to enhance control of a HVAC system. For examples, some embodiments of the teachings herein include a computerized device for controlling a HVAC system of a room. The computerized device may include: a providing unit for providing a metamodel modeling a distribution of a number of physical quantities of air in the room, the metamodel being based on reduced order modeling (ROM: Reduced Order Modeling) of a plurality of executed simulations of the physical quantities for a certain room configuration of the room; and a determining unit for determining at least one value of a certain physical quantity of the number of physical quantities at a certain location in the room using the provided metamodel and a number of measured values of the certain physical quantity being measured by a number of physical sensors.

In some embodiments, the number of physical quantities include an air temperature, an air velocity, a relative humidity, an absolute humidity and/or a $CO_2$-content of the air.

In some embodiments, the metamodel (M) models a 3D distribution of a plurality of physical quantities of the air in the room (1).

In some embodiments, the plurality of executed simulations(S) include CAE simulations the certain applied to room configuration.

In some embodiments, the room configuration describes a geometry of the room (1), in particular including an area of the room (1), a height of the room (1), windows (3, 4) of the room (1) and doors (2) of the room (1), a position of the room (1) in the building, a number of persons in the room (1), locations of the persons in the room (1), objects (5) in the room (1) and/or locations of the objects (5) in the room (1).

In some embodiments, the reduced order modeling (ROM) includes machine learning.

In some embodiments, the reduced order modeling (ROM) includes a simulation and/or a number of empirical models.

In some embodiments, the simulations(S) are executed for a plurality of locations in the room (1), wherein each of the simulations(S) is executed based on a set of boundary conditions.

In some embodiments, the determining unit (120) is configured to determine the value (V) of the certain physical quantity at any location in the room (1).

In some embodiments, the metamodel (M) is built based on a plurality of parametrical simulations(S), which are approximated using the reduced order modeling (ROM), in particular using machine learning, into a set of algebraic equations (AE) for a set of desired physical quantities.

In some embodiments, the set of algebraic equations (AE) are formed as a system of linear equations, in which a column vector of the desired physical quantities is equaled to a sum of a product of a matrix describing the measured values of the physical quantities and a column vector of metamodel coefficients and a column vector of discrepancy.

In some embodiments, there is a receiving unit (130) for receiving a request (R) defining a desired temperature at a desired location in the room (1), and a generating unit (140) for generating a control signal (C) for controlling the HVAC system (10) based on the least one value (V) of the certain physical quantity determined by the determining unit (120) and the received request (R).

As another example, some embodiments include an HVAC system (10) comprising: a computerized device (100) as described herein, and a number of fan coil units (11-14) for adjusting at least one property of the air in the room (1), the fan coil units (11-14) being controlled by the computerized device (100).

As another example, some embodiments include a computer-implemented method for controlling a HVAC system (10) of a room (1), the method comprising: providing (401) a metamodel (M) modeling a distribution of a number of physical quantities of air in the room (1), the metamodel (M) being based on reduced order modeling (ROM) of a plurality of executed simulations(S) of the physical quantities for a certain room configuration of the room (1), and determining (402) at least one value (V) of a certain physical quantity of the number of physical quantities at a certain location in the room (1) using the provided metamodel (M) and a number of measured values (Q) of the certain physical quantity being measured by a number of physical sensors.

As another example, some embodiments include a computer program product comprising a program code for executing one or more of the methods as described herein for operating for controlling a HVAC system when run on at least one computer.

BRIEF DESCRIPTION OF THE DRAWINGS

Further embodiments, features, and advantages of the teachings of the present disclosure will become apparent from the subsequent description, taken in conjunction with the accompanying drawings, in which.

DETAILED DESCRIPTION

Figure 1:
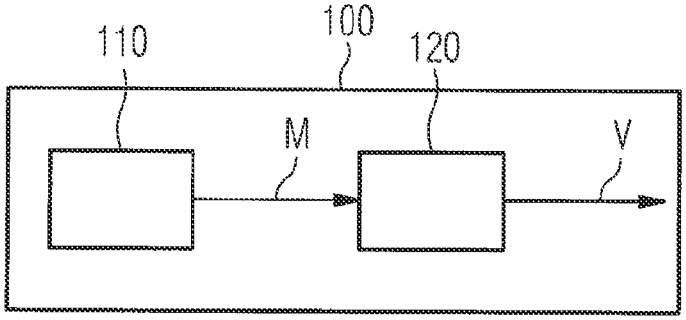
FIG. 1 shows a schematic block diagram of a first embodiment of a computerized device for controlling a HVAC system of a room.

In various embodiments of the teachings herein, the number of physical sensors are arranged in the room or near the room and at locations being different to the certain location. For example, the number of physical quantities include an air temperature, an air velocity, a relative humidity, an absolute humidity and/or a $CO_2$-content of the air. The physical quantities of the air may be also referred to as air properties. The computerized device may be also referred to as control system, control device or controller. In particular, the computerized device may be a smart controller.

The computerized devices incorporating teachings of the present disclosure improve the accuracy of the prediction of the air properties in the room, in particular at any location in the room. That means that the computerized device is adapted to determine an air property, like the temperature, also at those locations where no physical sensor is located. Therefore, the overall HVAC system performance is increased.

In particular, by use of the metamodels described herein, the computerized device accounts for peculiarities of any particular space in the room allowing application of the perfect place concept by achieving more comfortable environmental conditions for persons at very location in the room. Furthermore, the metamodel-based control systems have less strict requirements for the location of the physical sensors. Therefore, the installation process is noticeably simplified.

The metamodels described herein require far less computational power than CAE simulation, so it can be directly embedded into the computerized device, e. g. a smart controller.

In some embodiments, the metamodel models a 3D (three-dimensional) distribution of a plurality of physical quantities of the air in the room. In this embodiment, the metamodel may model the distributions of all of above-mentioned physical quantities or of any subset of them.

In some embodiments, the plurality of executed simulations include CAE simulations applied to the certain room configuration (CAE: Computer Aided Engineering). In particular, the exact CAE model may be built for any geometry of the room. In particular, a proper orthogonal decomposition and/or a Krylov subspace approach may be applied for building the metamodel.

In some embodiments, the room configuration describes a geometry of the room, in particular including an area of the room, a height of the room, windows of the room and doors of the room, a position of the room in the building, a number of persons in the room, locations of the persons in the room, objects in the room and/or locations of the objects in the room.

In some embodiments, the reduced order modeling includes machine learning (ROM: reduced order modeling).

In some embodiments, the reduced order modeling a includes simulation and/or a number of empirical models.

In some embodiments, the simulations are executed for a plurality of locations in the room, wherein each of the simulations is executed based on a set of boundary conditions.

In some embodiments, the determining unit is configured to determine the value of the certain physical quantity at any location in the room.

In some embodiments, the metamodel is built based on a plurality of parametrical simulations, which are approximated using the reduced order modeling, in particular using machine learning, into a set of algebraic equations for a set of desired physical quantities.

In some embodiments, the set of algebraic equations are formed as a system of linear equations, in which a column vector of the desired physical quantities is equaled to a sum of a product of a matrix describing the measured values of the physical quantities and a column vector of metamodel coefficients and a column vector of discrepancy.

An example for such a system of linear equations is shown below:

$$\begin{bmatrix} y_1 \\ y_2 \\ y_3 \\ \vdots \\ y_n \end{bmatrix} = \begin{bmatrix} 1 & x_1 & x_1^2 & \dots & x_1^m \\ 1 & x_2 & x_2^2 & \dots & x_2^m \\ 1 & x_3 & x_3^2 & \dots & x_3^m \\ \vdots & \vdots & \vdots & \ddots & \vdots \\ 1 & x_n & x_n^2 & \dots & x_n^m \end{bmatrix} \begin{bmatrix} \beta_1 \\ \beta_2 \\ \beta_3 \\ \vdots \\ \beta_n \end{bmatrix} + \begin{bmatrix} \varepsilon_1 \\ \varepsilon_2 \\ \varepsilon_3 \\ \vdots \\ \varepsilon_n \end{bmatrix}$$

In said system of linear equations, the column vector represents the desired physical quantities. In the matrix, x represents the measured values of the physical quantities, the column vector β represents the metamodel coefficients, and the column vector ε represents the discrepancies.

In some embodiments, the computerized device includes: a receiving unit for receiving a request defining a desired temperature at a desired location in the room, and a generating unit for generating a control signal for controlling the HVAC system based on the least one value of the certain physical quantity determined by the determining unit and the received request. For example, the receiving unit may be coupled to a remote controller to which the user can input his request for defining the desired temperature, in particular at his location in the room. The request may be then transferred to the receiving unit of the computerized device. Then, the providing unit provides the control signal for controlling said HVAC system based on the received request from the user.

The respective unit, e.g. the providing unit or the determining unit, may be implemented in hardware and/or in software. If said unit is implemented in hardware, it may be embodied as a device, e.g. as a computer or as a processor or as a part of a system, e.g. a computer system. If said unit is implemented in software, it may be embodied as a computer program product, as a function, as a routine, as a program code or as an executable object. In particular, the computerized device may be a computer. Moreover, the computerized device may be or may include a computer-aided or computer-related system or a computer system.

In some embodiments, a HVAC system comprises a computerized device as described herein and a number of fan coil units for adjusting at least one property of the air in the room, the fan coil units being controlled by the computerized device. The user may directly or remotely input a request for a certain temperature at a certain location in the room, and the HVAC system may adjust that temperature by controlling said fan coil units.

In some embodiments, a computer-implemented method for controlling a HVAC system of a room comprises: providing a metamodel modeling a distribution of a number of physical quantities of air in the room, the metamodel being based on reduced order modeling of a plurality of executed simulations of the physical quantities for a certain room configuration of the room, and determining at least one value of a certain physical quantity of the number of physical quantities at a certain location in the room using the provided metamodel and a number of measured values of the certain physical quantity being measured by a number of physical sensors.

In some embodiments, a computer program product comprises a program code for executing the method of the third aspect when the program code is run on at least one computer. A computer program product, such as a computer program means, may be embodied as a memory card, USB stick, CD-ROM, DVD or as a file which may be downloaded from a server in a network. For example, such a file may be provided by transferring the file comprising the computer program product from a wireless communication network.

Further possible implementations or alternative solutions of the invention also encompass combinations—that are not explicitly mentioned herein—of features described above or below with regard to the embodiments. The person skilled in the art may also add individual or isolated aspects and features to the most basic form of the teachings herein. In the Figures, like reference numerals designate like or functionally equivalent elements, unless otherwise indicated.

Figure 3:
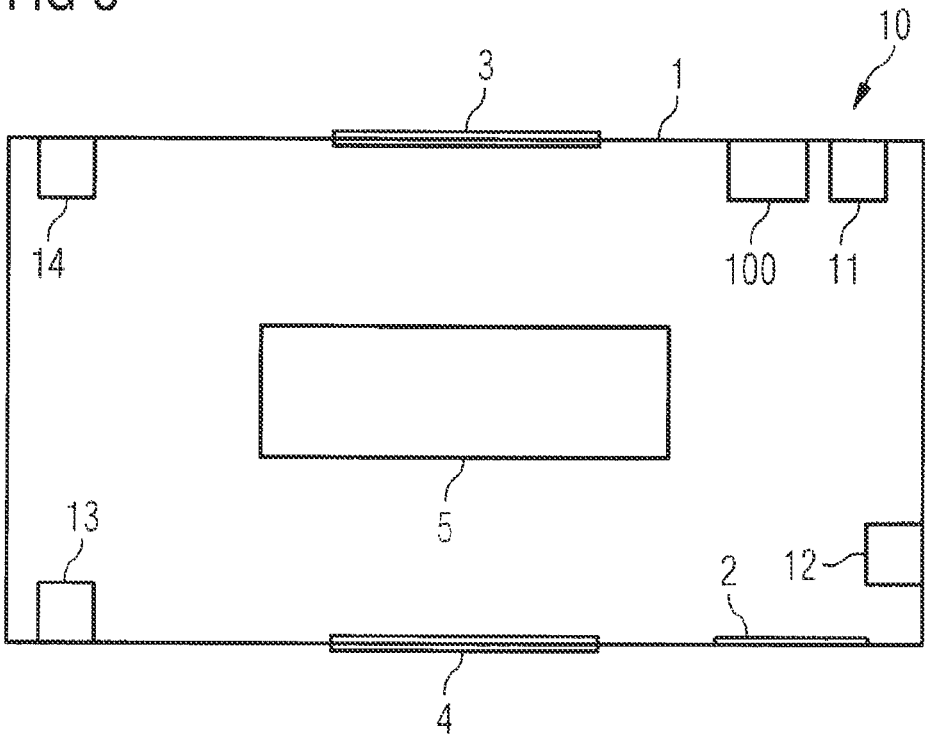
FIG. 3 shows a schematic diagram illustrating an example of a room including a HVAC system and a computerized device for controlling the HVAC system.

FIG. 1 depicts a schematic block diagram of a first embodiment of a computerized device 100 incorporating teachings of the present disclosure for controlling a HVAC system 10 of a room 1. An example of a room 1 including a HVAC system 10 and the computerized device 100 of FIG. 1 is shown in FIG. 3. The schematic of the room 1 according to FIG. 3 shows that the room 1 has a door 2, two windows 3, 4 and a desk 5 as an example for an object. Of course, such a room 1 may have any other room configuration including any number of doors 2, any number of windows 3, 4 and any number of objects 5.

Further, in the room 1 of FIG. 3, there is the HVAC system 10 including the computerized device 100 of FIG. 1 and a number of fan coil units 11-14. Without loss of generality, the room 1 of FIG. 3 has four fan coil units 11, 12, 13 and 14.

Referring to FIG. 1, the computerized device 100 for controlling the HVAC system 10 comprises a providing unit 110 and a determining unit 120. The providing unit 110 is configured to provide a metamodel M modeling a distribution of a number of physical quantities of air in the room 1. The metamodel M is based on reduced order modeling ROM of a plurality of executed simulations S of the physical quantities for a certain room configuration of the room 1. As mentioned above, an example for such a room configuration of the room 1 is shown in FIG. 3.

The number of physical quantities may include an air temperature, an air velocity, a relative humidity, an absolute humidity and/or a $CO_2$ content of the air. In particular, the metamodel M models a 3D distribution of a plurality of said physical quantities of the air in the room 1. The plurality of executed simulations S may include CAE simulations applied to the certain room configuration, for example according to FIG. 3. The room configuration particularly describes a geometry of the room 1 including an area of the room 1, a height of the room 1, windows 3, 4 of the room 1 and doors 2 of the room 1, a position of the room 1 in the building including said room 1, a number of persons in the room 1, locations of the persons in the room 1, objects, like the desk 5 in FIG. 3, in the room 1 and locations of the objects 5 in the room 1.

Said reduced order modeling error ROM may include machine learning, a simulation and/or a number of empirical models. The simulations S may be executed for a plurality of locations in the room 1. Each of said simulations S may be executed based on a set of boundary condition, in particular different boundary conditions.

The determining unit 120 of the computerized device 100 of FIG. 1 is configured to determine at least one value V of a certain physical quantity of the number of physical quantities at a certain location in the room 1 using the provided metamodel M and a number of measured values Q of the certain physical quantity being measured by a number of physical sensors (not shown). In particular, the determining unit 120 is configured to determine the value V of the certain physical quantity at any location in the room 1.

Figure 2:
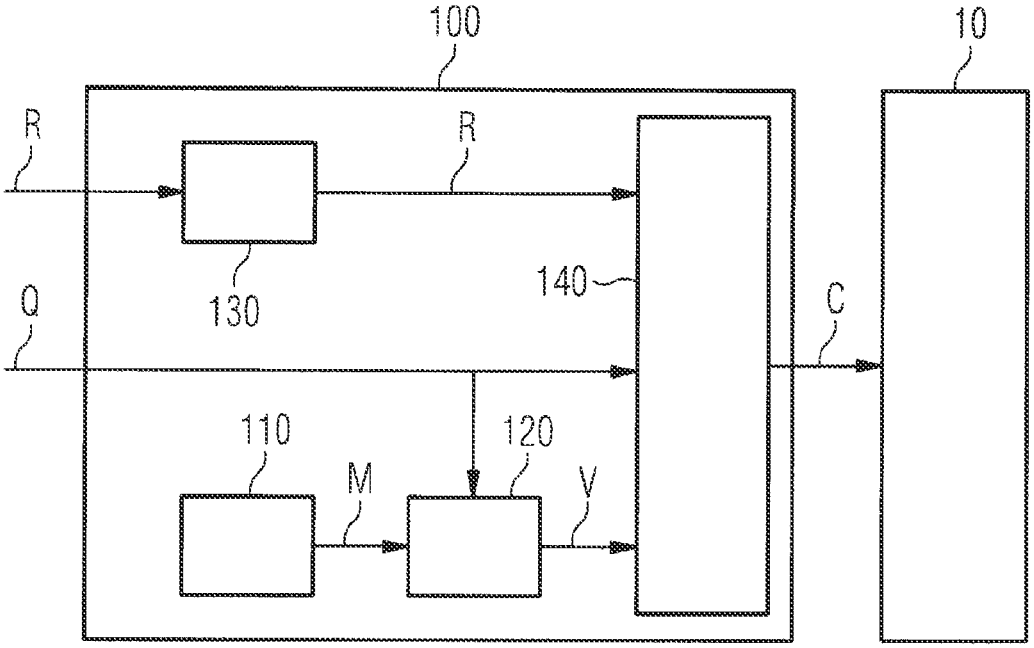
FIG. 2 shows a schematic block diagram of a second embodiment of a computerized device for controlling a HVAC system of a room.

Further, FIG. 2 shows a schematic block diagram of a second embodiment of a computerized device 100 incorporating teachings of the present disclosure for controlling a HVAC system 10 of a room 1. The second embodiment of FIG. 2 includes all features of the first embodiment of FIG. 1. Additionally, the computerized device 100 of FIG. 2 includes a receiving unit 130 and a generating unit 140.

The receiving unit 130 is configured to receive a request R defining a desired temperature at a desired location in the room, in particular from a user. The receiving unit 130 transmits the received request R to the generating unit 140.

As mentioned with reference to FIG. 1, the providing unit 110 provides a metamodel M for the determining unit 120. The providing unit 110 may be a memory storing said metamodel M. In an alternative, the metamodel M may be stored in a cloud storage and the providing unit 110 may fetch the metamodel M from the cloud storage and provide it to the determining unit 120. Further, the determining unit 120 receives measured values Q of the physical quantities measured by a number of physical sensors (not shown) arranged at different locations in the room 1.

Then, the determining unit 120 determines at least one value V of the certain physical quantity at a certain location in the room 1 using the provided metamodel M and the measured values Q provided by the physical sensors in the room 1.

Then, the generating unit 140 may generate a control signal C for controlling the HVAC system 10 based on the at least one value V provided by the providing unit 120, the measured values Q provided by the physical sensors and the request R received by the receiving unit 130.

In particular, with reference to FIG. 3, the generating unit 140 may provide the control signal C or a further control signal derived from said control signal C to the number of fan coil units 11-14 arranged in the room 1 of FIG. 3.

Figure 4:
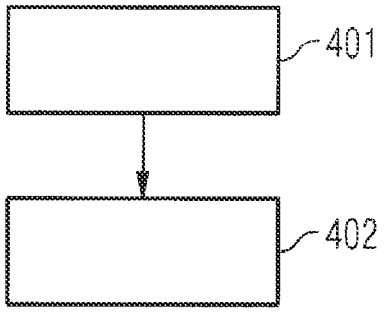
FIG. 4 shows a sequence of method steps of a first embodiment of a method for controlling a HVAC system of a room.

FIG. 4 shows a sequence of method steps of a first embodiment of a method incorporating teachings of the present disclosure for controlling a HVAC system 10 of a room 1. An example for a room 1 including a HVAC system 10 is depicted in FIG. 3. The method of FIG. 4 includes the following method steps 401 and 402:

In step 401, a metamodel M modeling a distribution of a number of physical quantities of air in the room 1 is provided. The metamodel M is based on reduced order modeling ROM of a plurality of executed simulations S of the physical quantities for a certain room configuration of the room 1.

In step 402, at least one value V of a certain physical quantity of the number of physical quantities at the certain location in the room 1 is determined using the provided metamodel M and the number of measured values Q of the certain physical quantity being measured by a number of physical sensors arranged in the room 1.

Figure 5:
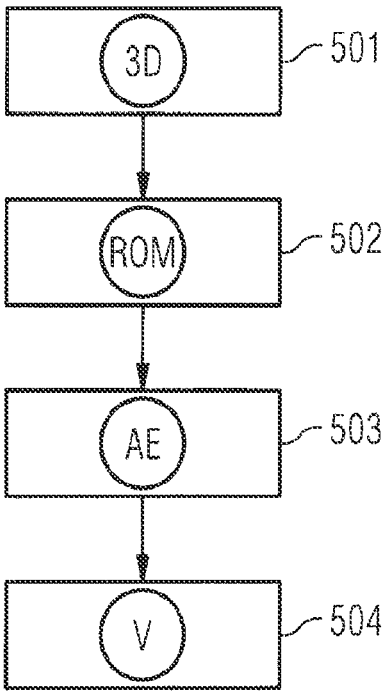
FIG. 5 shows a sequence of method steps of a second embodiment of a method for controlling a HVAC system of a room.

Moreover, FIG. 5 shows a sequence of method steps of a second embodiment of a method incorporating for controlling a HVAC system 10 of a room 1. The method of FIG. 5 includes the following methods steps 501-504:

In step 501, 3D distributions of a number of physical quantities of air in the room 1 are provided.

In step 502, the 3D distributions are proceeded within the reduced order modeling ROM, e.g. with the use of at least one machine learning algorithm. This process of step 502 transforms a huge database to algebraic equations AE for the desired physical quantities which are provided in step 503. The algebraic equations AE can be easily deployed to a computerized device 100 (see step 504). The computerized device 100 may be referred to as virtual sensor, because it provides a value V of a certain physical quantity at a certain location in the room 1 at which no physical sensor is located.

Although the teachings of the present disclosure has been described in accordance with example embodiments, it is obvious for the person skilled in the art that modifications are possible in all embodiments.

REFERENCE NUMERALS

1 room
2 door
3 window
4 window
5 desk
10 HVAC system
11 fan coil unit
12 fan coil unit
13 fan coil unit
14 fan coil unit
100 computerized device
110 providing unit
120 determining unit
130 receiving unit
140 generating unit
AE algebraic equations
C control signal
M metamodel
Q measured value of physical quantity
R request
ROM reduced order modeling
S simulation
V value of physical quantity

What is claimed is:

1. A device for controlling a HVAC system of a room, the device comprising:

a memory storing a metamodel for a distribution of physical quantities of air in the room, the metamodel based on reduced order modeling of a plurality of executed simulations of the physical quantities for a first configuration of the room;

a processor programmed to determine a value of a first subset of the physical quantities at a certain location in the room using the metamodel and a set of measured values of each physical quantity being measured by a number of physical sensors;

a receiving unit for receiving a request defining a desired temperature at a desired location in the room; and a controller for generating a control signal for controlling the HVAC system based on the value of one or more of the first subset of the physical quantities determined and the received request;

wherein the metamodel is based on a plurality of parametrical simulations approximated using reduced order modeling into a set of algebraic equations for a set of desired physical quantities;

the set of algebraic equations include a system of linear equations; and the system of linear equations provide a column vector of the desired physical quantities is equal to a sum of a product of a matrix describing the measured values of the physical quantities and a column vector of metamodel coefficients and a column vector of discrepancy.

2. The device of claim 1, wherein the first subset of physical quantities include: air temperature, air velocity, relative humidity, absolute humidity, and/or $CO_2$-content of air.

3. The device of claim 1, wherein the metamodel models a 3D distribution of a plurality of physical quantities of the air in the room.

4. The device of any of claim 1, wherein the plurality of executed simulations includes computer aided engineering (CAE) simulations applied to the certain room configuration.

5. The device of any of claim 1, wherein the room configuration describes a geometry of the room including an area of the room, a height of the room, windows and doors of the room, a position of the room in the building, a number of persons in the room, locations of persons in the room, objects in the room, and/or locations of objects in the room.

6. The device of claim 1, wherein the reduced order modeling includes machine learning.

7. The device of claim 1, wherein the reduced order modeling includes a simulation and/or a number of empirical models.

8. The device of claim 1, wherein:

the simulations are executed for a plurality of locations in the room; and each of the simulations is executed based on a set of boundary conditions.

9. The device of claim 1, wherein the processor is further programmed to determine the value of the certain physical quantity at any location in the room.

10. A HVAC system comprising:

a memory storing a metamodel for a distribution of physical quantities of air in the room, the metamodel based on reduced order modeling of a plurality of executed simulations of the physical quantities for a first configuration of the room; and a processor programmed to determine a value of a first subset of the physical quantities at a certain location in the room using the metamodel and a set of measured values of each physical quantity being measured by a number of physical sensors;

a receiving unit for receiving a request defining a desired value for at least one property of the air at a desired location in the room;

wherein the processor generates a control signal for controlling the HVAC system based on the value of one or more of the first subset of the physical quantities determined and the received request; and a fan coil unit controlled by the processor to adjust the at least one property of the air at the desired location in the room;

wherein the metamodel is based on a plurality of parametrical simulations approximated using reduced order modeling into a set of algebraic equations for a set of desired physical quantities;

the set of algebraic equations include a system of linear equations; and the system of linear equations provide a column vector of the desired physical quantities is equal to a sum of a product of a matrix describing the measured values of the physical quantities and a column vector of metamodel coefficients and a column vector of discrepancy.

* * * * *